US008158915B2

(12) United States Patent
Earle

(10) Patent No.: US 8,158,915 B2
(45) Date of Patent: Apr. 17, 2012

(54) CANARD-CENTRIC MISSILE SUPPORT

(75) Inventor: Matthew S. Earle, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 784 days.

(21) Appl. No.: 12/244,461

(22) Filed: Oct. 2, 2008

(65) Prior Publication Data

US 2010/0276534 A1 Nov. 4, 2010

(51) Int. Cl.
*F42B 15/00* (2006.01)

(52) U.S. Cl. ..... 244/3.29; 244/45 A; 244/49; 89/1.816

(58) Field of Classification Search ..... 244/3.27–3.29, 244/45 A, 49; 89/1.816
See application file for complete search history.

(56) References Cited

U.S. PATENT DOCUMENTS

| | | | | | |
|---|---|---|---|---|---|
| 2,998,754 | A * | 9/1961 | Bialy | 89/1.816 |
| 3,580,529 | A * | 5/1971 | Suter | 244/3.29 |
| 3,697,019 | A * | 10/1972 | Watson | 244/3.29 |
| 4,296,895 | A * | 10/1981 | Pazmany | 244/3.29 |
| 4,778,127 | A * | 10/1988 | Duchesneau | 244/3.29 |
| 4,852,455 | A * | 8/1989 | Brum | 89/1.14 |
| 5,400,689 | A * | 3/1995 | Hutter et al. | 89/1.816 |
| 6,869,044 | B2 * | 3/2005 | Geswender et al. | 244/3.29 |
| 2004/0011919 | A1 * | 1/2004 | Johnsson et al. | 244/3.29 |
| 2004/0050997 | A1 * | 3/2004 | Banks et al. | 244/3.29 |
| 2007/0045466 | A1 * | 3/2007 | Hellis | 244/3.29 |
| 2007/0152097 | A1 * | 7/2007 | Melkers et al. | 244/3.21 |

* cited by examiner

*Primary Examiner* — Rob Swiatek
*Assistant Examiner* — Marisa Conlon
(74) *Attorney, Agent, or Firm* — Schwegman, Lundberg & Woessner, P.A.

(57) ABSTRACT

A canard includes a first section and a second section. The first section is configured for the coupling of radial forces to a fuselage of an air vehicle, and the first section is coupled to the second section via a hinge somewhere along the radial extent of the canard. An edge of the first section near the hinge provides a load support for the air vehicle within a launch canister.

15 Claims, 2 Drawing Sheets

CANARD-CENTRIC MISSILE SUPPORT

TECHNICAL FIELD

The present invention relates to support systems for missiles within a launching canister, and in an embodiment, but not by way of limitation, a canard-centric missile support system.

BACKGROUND

In many missile launching systems, a canard is positioned near the nose of the missile to stabilize the missile in flight. Such canards are normally hinged near the root or point of attachment to the missile, which allows the canard to be folded and the missile to be positioned into a launch canister. In such a missile launching system, the canard does not provide support for any load while positioned in the launch canister. When the missile is then launched, a spring or other tension/force imparting mechanism coupled with or integral to the hinge causes the canard to move into its flight position, which is substantially perpendicular to a tangent of the housing of the missile.

In some missile launching systems, different sections of the missile have different diameters. Most commonly in such systems, an aft section of the missile has a larger diameter than the forward or nose section of the missile. These missiles require a launch canister that is large enough to hold the largest diameter section of the missile. Thus, the forward section of the missile is in cantilever. This creates a situation in which there is not an insubstantial amount of free space between the smaller diameter forward section of the missile and the inside wall of the launch canister. This dead space can result in unwanted movement or flexure of the missile within a launch canister, caused by lateral shock loads (i.e, across a diameter of the launch canister) occurring during normal handling of the missile systems or when a near miss explodes near the launch canister. Such movement of the missile within the launch canister can be minimized by placing a ring or collar around the smaller diameter section of the missile. However, upon launch, such ring or collar is jettisoned, and can cause damage to personnel and/or property at the launch site.

DETAILED DESCRIPTION

Figure 1B:
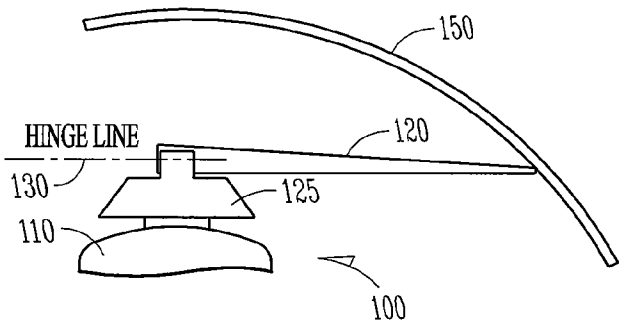
FIG. 1B (PRIOR ART)
FIG. 1B illustrates the missile canard of FIG. 1A positioned within a missile launch canister.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

Figure 1A:
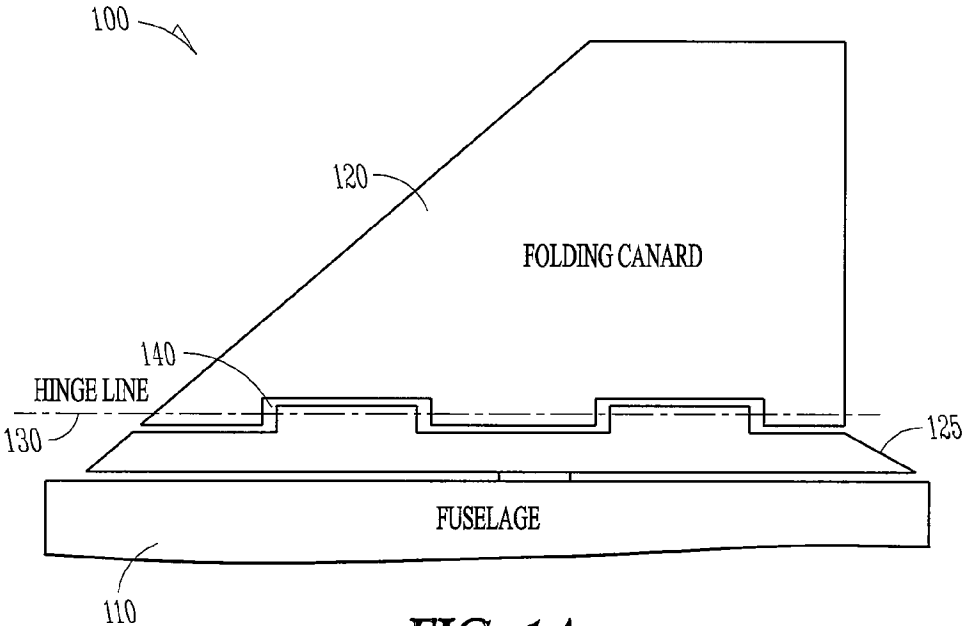
FIG. 1A (PRIOR ART)
FIG. 1A illustrates an example embodiment of a missile canard.

FIGS. 1A and 1B illustrate a canard 100 and a canard 100 positioned within a launching canister 150 respectively. The canard 100 includes a first section 125 and a second section 120. The first section of the canard is connected to a fuselage 110 of a missile. While an embodiment of the present disclosure is described for use in connection with a missile, other embodiments include other air vehicles. The first section 125 and the second section 120 are connected together by a hinge 140. The hinge 140 permits the first section 125 and the second section 120 to be in alignment in the same plane, and then pivot for folding to form an acute angle as illustrated in FIG. 1B. In lieu of the hinge 140, other pivot means or means to force the first section 125 and the second section 120 into alignment in a plane, and then pivot to form an angle, could be used, such as a ball and socket type of joint or connection. As can be seen from FIG. 1B, the folding of the canard to an acute angle permits the insertion of the missile into the launch canister. The canard as shown in FIG. 1B has virtually no lateral shock or other substantial load bearing capacity.

Figure 2B:
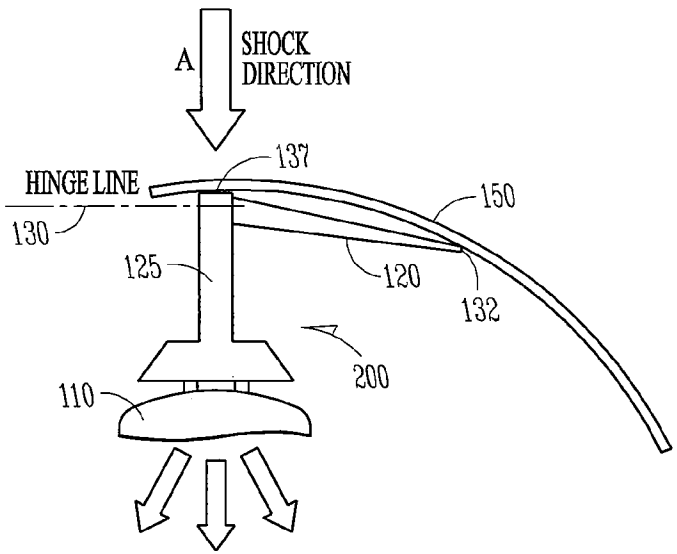
FIG. 2B illustrates the missile canard of FIG. 2A positioned within a missile launch canister.
Figure 2A:
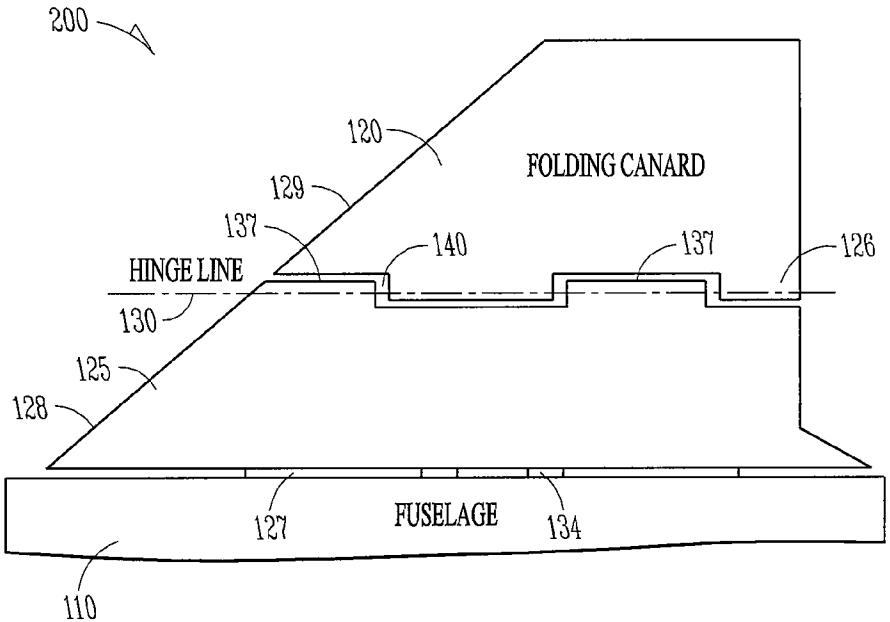
FIG. 2A illustrates an example embodiment of a missile canard used in a missile canard support system.

FIGS. 2A and 2B illustrate a folding canard system 200 that not only functions as a means to allow the insertion of a missile into a launching canister, but that further functions as a load bearing, support, and stabilization system for the missile while the missile is in the launch canister 150. FIG. 2A illustrates a canard 200 with a first section 125 and a second section 120. Unlike the canard of FIGS. 1A and 1B, the canard 200 of FIGS. 2A and 2B is hinged outboard of the root 127 of the canard near an approximate midpoint 126 of the canard, dividing the first section 125 and the second section 120 of the canard along a radial extent of the canard, that is, somewhere distant or apart from a root 134 of the canard.

As illustrated in FIG. 2B, the canard 200 can be folded such that the first section 125 and the second section 120 form an acute angle, and the canard and missile can then be positioned into the launch canister 150. As further illustrated in FIG. 2B, an edge 137 of the first section 125 of the canard contacts the inner wall of the launch canister, and as indicated by arrow A, can withstand an externally generated shock, or intentionally couple this shock into the fuselage 110. In an embodiment, this shock can be referred to as a lateral shock, since the force experienced by the launch canister 150 and the first section 125 occurs across an axial sector of canister 150 as indicated by arrow A in FIG. 2B. This lateral shock can be dissipated through the first section 125, fuselage features 134, and the fuselage 110. The exposed forward surfaces of the first section 125 and the second section 120 at points 128 and 129, or simply somewhere near the hinge line 130, can be chamfered or otherwise treated to reduce gouging of the internal wall of the launch canister upon egress of a missile. The tip 132 of the second section 120 of the canard also rests against the inside wall of the launch canister, but this does not provide any substantial support against external shocks.

Fuselage features 134, if needed, transfer canard axial loads to the fuselage 110 as axial free play is stopped by such a feature. The feature 134 could be a passive land feature machined into the fuselage 110 below the canard first section 125 to distribute the loads into the missile structure. The canard is still free however to pivot in flight due to residual axial free play. An extra benefit of the canard 200 is a reduced panel (bending) load at the hinge 140 in flight.

In the foregoing detailed description of embodiments of the invention, various features are grouped together in one or more embodiments for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the detailed description of embodiments of the invention, with each claim standing on its own as a separate embodiment. It is understood that the above description is intended to be illustrative, and not restrictive. It is intended to cover all alternatives, modifications and equivalents as may be included within the scope of the invention as defined in the appended claims. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

The abstract is provided to comply with 37 C.F.R. 1.72(b) to allow a reader to quickly ascertain the nature and gist of the technical disclosure. The Abstract is submitted with the understanding that it will not be used to interpret or limit the scope or meaning of the claims.

The invention claimed is:

1. An apparatus comprising:

a first section of a canard; and a second section of the canard;

wherein the first section is coupled to a fuselage of an air vehicle;

wherein the first section is coupled to the second section via a hinge along a radial extent of the canard at an approximate midpoint of the canard distant from the coupling of the first section to the fuselage;

wherein the air vehicle is positioned in a launch canister; and wherein an edge of the first section proximate to the hinge contacts the launch canister; and wherein the second section comprises a distal tip, the tip resting against the inside wall of the launch canister.

2. The apparatus of claim 1, wherein the contact of the edge of the first section with the launch canister comprises a load support against a lateral shock by dissipating the lateral shock through the first section of the canard and the fuselage of the air vehicle.

3. The apparatus of claim 1, wherein the air vehicle comprises a missile.

4. The apparatus of claim 1, wherein the hinge comprises a spring, the spring configured to exert a force such that the first section and second section are aligned in the same plane.

5. The system of claim 1, wherein an edge of the second section distal from the hinge contacts the launch canister.

6. An apparatus comprising:

a canard, the canard comprising a first section and a second section, wherein the first section is configured for coupling to a fuselage of an air vehicle; and wherein the first section is coupled to the second section via a hinge along a radial extent of the canard at an approximate midpoint of the canard distant from the coupling of the first section to the fuselage;

a launching canister configured to receive the air vehicle, wherein the air vehicle is positioned within the canister; and an edge of the first section near the hinge, the edge being in contact with an inside wall of the canister, thereby providing a load support against a lateral shock for the air vehicle in the canister by dissipating the lateral shock through the first section of the canard and the fuselage of the air vehicle; a distal edge of the second section comprising a tip, the tip resting against the inside wall of the launching canister.

7. The apparatus of claim 6, wherein the air vehicle comprises a missile.

8. The apparatus of claim 6, comprising the air vehicle.

9. The apparatus of claim 6, wherein the hinge comprises means to force the first section and the second section into alignment in a same plane.

10. A system comprising:

a launch canister;

an air vehicle positioned in the launch canister;

a canard, comprising a first section and a second section, coupled to the air vehicle via the first section; and an edge of the first section that contacts the launch canister and provides a load support for the air vehicle in the launch canister;

wherein the first section is coupled to the second section via a pivot means along a radial extent of the canard at an approximate midpoint of the canard distant from the coupling of the first section to the air vehicle;

wherein the second section comprises a distal tip, the tip resting against the inside wall of the launch canister.

11. The system of claim 10, wherein the load support comprises support against a lateral shock by dissipating the lateral shock through the first section of the canard and the fuselage of the air vehicle.

12. The system of claim 10, wherein the air vehicle comprises a missile.

13. The system of claim 10, wherein the pivot means comprises a hinge or a ball and socket joint.

14. The system of claim 10, wherein the pivot means comprises a hinge and spring to force the first section and the second section into alignment in a same plane.

15. The system of claim 10, wherein the edge of the first section is near the pivot means, and the edge is in proximity to an inside wall of the canister.

* * * * *